United States Patent [19]

Nino

[11] Patent Number: 4,922,389

[45] Date of Patent: May 1, 1990

[54] HEADLIGHT DEVICE FOR VEHICLE

[75] Inventor: Naohi Nino, Shizuoka, Japan

[73] Assignee: Koito Seisakusho Co., Ltd., Shizuoka, Japan

[21] Appl. No.: 334,618

[22] Filed: Apr. 7, 1989

[30] Foreign Application Priority Data

Apr. 8, 1988 [JP] Japan ..... 63-86437

[51] Int. Cl.[5] ..... F21V 13/10

[52] U.S. Cl. ..... 362/61; 362/305; 362/343

[58] Field of Search ..... 362/61, 80, 296, 307, 362/310, 343, 297, 303, 347, 350, 346, 305

[56] References Cited

U.S. PATENT DOCUMENTS 4,100,594 7/1978 Gould ..... 362/308

4,511,955 4/1985 Ernst et al. ..... 362/347

4,772,987 9/1988 Kretschmer et al. ..... 362/61

4,800,467 1/1989 Lindae et al. ..... 362/61

4,851,968 7/1989 Nino ..... 362/61

*Primary Examiner*—Stephen F. Husar

*Attorney, Agent, or Firm*—Sughrue, Mion, Zinn, Macpeak & Seas

[57] ABSTRACT

A headlight having a reflector with the optical axis thereof being inclined relative to the optical axis of the headlight, a light source provided on a focus of the reflector and on the optical axis thereof, a projector lens in front of the reflector, and a shade plate provided nearly on a focus of the projector lens. The reflective surface of the reflector is formed to reflect the light emitted from the light source and to converge the reflected light into a curved line on a plane parallel to a plane including the optical axis of the headlight.

5 Claims, 13 Drawing Sheets

HEADLIGHT DEVICE FOR VEHICLE

BACKGROUND OF THE INVENTION

1. Field of the Invention

The present invention relates to a headlight device for a vehicle such as an automobile and the like and, particularly to a novel headlight device adapted for that having a reflector with the optical axis thereof being inclined relative to the optical axis of the headlight.

2. Description of Prior Art (FIGS. 7 and 8)

Various headlights have been proposed and utilized, and it is usually required that a desired pattern is formed by the light beam of the headlight so as to improve the safety in the traffic.

FIG. 7 is a schematic perspective view of an automotive headlight "a" according to prior art, in which x-axis is an axis passing the first focus "f" of the reflective surface "c" of a reflector "b" of the headlight "a" and the focus "e" of a projector lens "d" which is disposed in front of the reflector "b", and y and z-axes are determined to intersect orthogonally with each other and with the x-axis at the apex of the reflector "b".

The reflective surface "c" is formed to converge the light emitted from a light source "g" being located on the first focus "f" of the reflective surface "c" into the pattern of a quadratic curve "h" (which is referred hereinafter as a focal line) as viewed in the plan view.

Shown at "i" is a shade plate being disposed between the reflector "b" and the projector lens "d" and has a light cutting edge "j" on the upper edge thereof to define the upper edge of the light distribution pattern. The light cutting edge "j" has nearly the same configuration with the focal line "h" (a part of an ellipse in the drawing) as viewed in the plan view, and the edge "j" is located near to the focal line "h" of the reflector "b". The focus "e" of the projector lens "d" is located on the center of the light cutting edge "j" of the shade plate "i".

In the headlight "a", the light "k", "k", . . . emitted from the light source "g" being located on the first focus "f" of the reflective surface "c" of the reflector "b" and reflected by the reflective surface "c" will converge on the focal line "h" and, since the configuration of the focal line "h" is nearly the same to that of the light cutting edge "j" of the shade plate "i", a portion of the reflected light is shaded by the cutting edge "j" to form the light distributing pattern "l" as shown in double dotted chain line in FIG. 8(B) which has distinct upper edge as shown in the drawing. Incidentally, line H—H in the drawing is the horizontal line and line V—V is the vertical line.

However, when the reflector "b" is applied to such as a headlight a' which is shown in FIG. 8(A) and described in U.S. patent application Ser. No. 250,881, now U.S. Pat. No. 4,851,968, there arises following problems.

In the headlight a', the reflector is divided into a main reflector $b'_m$ positioned on the lower half with respect to the optical axis X—X for forming the high beam, and a sub reflector $b'_s$ positioned on the upper half of the reflector for forming the low beam. The optical axis of the main reflector $b'_m$ is the axis $X_m$—$X_m$ which inclines lower and forward relative to the axis X—X, and the optical axis of the sub reflector $b'_s$ is the axis $X_s$—$X_s$ which inclines upper and forward relative to the axis X—X. The electric bulb is formed to have a main filament m' nearly on the first focus $f'_1$ of the main reflector $b'_m$ and a sub filament n' nearly on the first focus $f'_2$ of the sub reflector $b'_s$.

Thus, when aforementioned reflective surface "c" of the reflector "b" is used as the reflective surface $c'_s$ of the sub reflector $b'_s$ the light emitted from the sub filament n' and reflected by the reflective surface "c" (shown as light k', k', . . . ) will converge on the focal line h' within a plane which is parallel to a plane including the optical axis $X_s$—$X_s$ of the sub reflector $b'_s$ and is projected forward through the projecting lens d' but, a portion of the reflected light is shaded or cut off by the light cutting edge j' of the shade plate i'. The light beam makes the pattern "o" as shown in the solid line in FIG. 8(B). The pattern "o" has drooped opposite end portions o' and o' as shown in the drawing. Therefore, desired pattern cannot be obtained.

Specifically, as shown in FIGS. 9(A) through 9(C), when a transparent plate "q" having a figure "p" representing the focal line thereon is rotated as shown in arrow line in FIG. 9(A) and is viewed from the arrow B direction, then, the opposite ends of the figure "p" which were initially seen on a straight line will increasingly displace upward as shown in FIG. 9(B). The projector lens d' acts to form the inverted image as shown in FIG. 9(C) which has the drooped opposite ends.

SUMMARY OF THE INVENTION

An object of the invention is to solve the problems above mentioned.

According to the invention, there is provided a headlight having a reflector with the optical axis thereof being inclined relative to the optical axis of the headlight, a light source provided on a focus of the reflector and on the optical axis thereof, a projector lens in front of the reflector, and a shade plate provided nearly on a focus of the projector lens, wherein the reflector comprises a reflective surface which reflects the light emitted from the light source and converges the reflected light into a curved line on a plane parallel to a plane including the optical axis of the headlight.

Thus, according to the present invention, the upper edge of the pattern of the light beam does not droop at the opposite end portions and extends along a distinct horizontal line, and the illuminating characteristics of the light beam is improved.

BRIEF DESCRIPTION OF THE DRAWINGS

Further objects and advantages of the invention will become apparent from the following detailed description in conjunction with accompanying drawings, in which:

FIG. 1 through FIG. 6 show a headlight device according to a first embodiment of the invention;

FIG. 1 is a schematic exploded perspective view of the headlight device;

FIG. 2 is a view showing the pattern of the light beam formed by the headlight of FIG. 1;

FIG. 3 is a view for illustrating the co-ordinate setting procedure;

DETAILED DESCRIPTION OF PREFERRED EMBODIMENTS

First Embodiment (FIG. 1 through FIG. 6)

Figure 1:
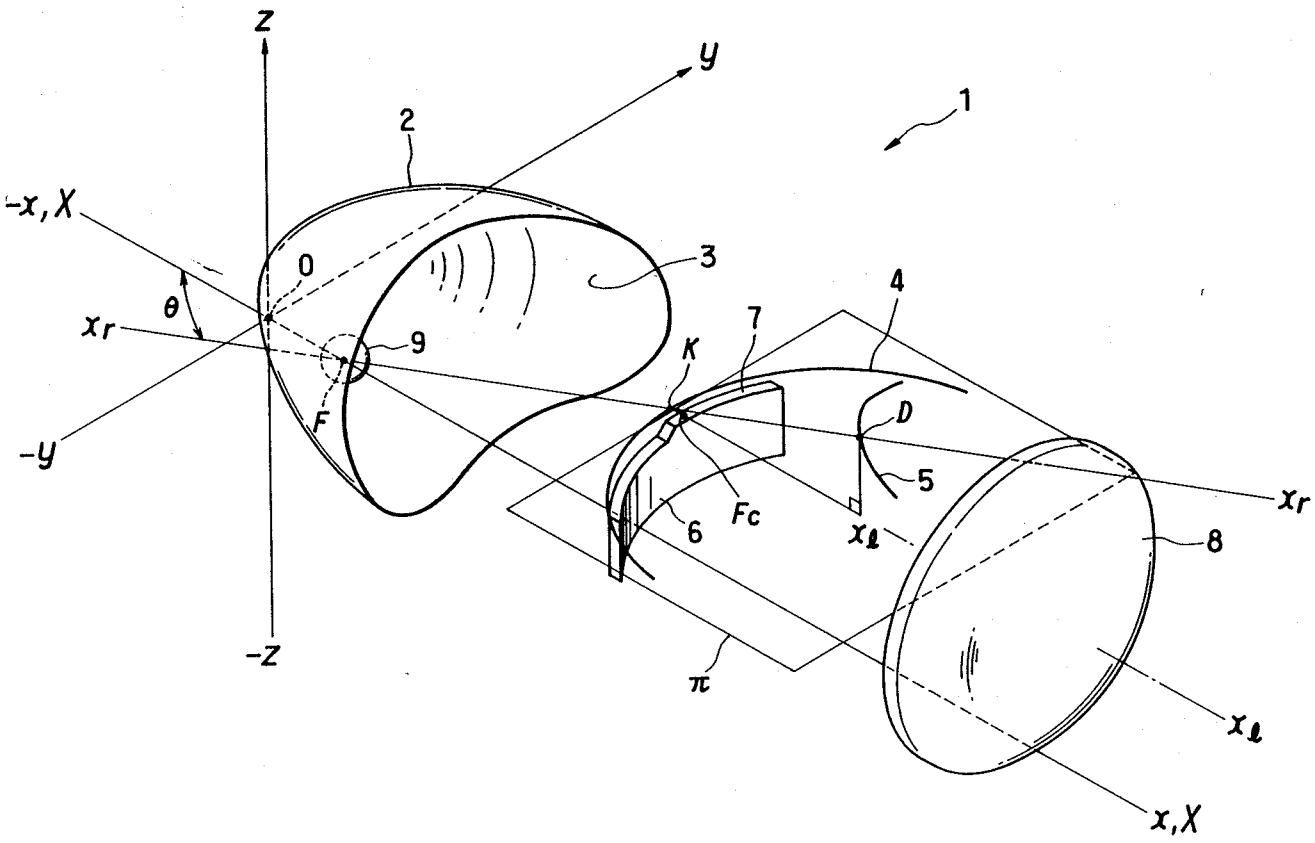

Shown at "1" in FIG. 1 is a headlight device according to the present invention. In FIG. 1, the co-ordinate is shown that x-axis aligns with the optical axis X—X, z-axis intersects orthogonally with x-axis at the origin "0" and extends vertically upward, and y-axis intersects orthogonally with x-axis and with z-axis at the origin "0" and extends horizontally.

Shown at numeral "2" is a reflector and the optical axis $x_r$—$x_r$ of which is inclined upward and forward with respect to the optical axis X—X of the headlight "1" by an angle $\theta$. The reflector "2" includes a reflective surface "3" which reflects the light emitted from a light source on the first focus F, converges the light on a focal line "4" of a quadratic curve passing through the second focus K (the focal line "4" is hereinafter referred as a second focal line) and, thereafter, converges the light on a focal line "5" of a quadratic curve passing through the third focus D (the focal line "5" is hereinafter referred to as a third focal line). The second focal line "4" is included in a plane $\pi$ which is parallel to x-y plane or the plane defined by the x-axis and the y-axis.

Shown at numeral "6" is a shade plate. The upper edge "7" of the shade plate "6" acts to define the upper edge of the light distribution pattern of the light beam, thus, the edge "7" is called as light cutting edge to shade or cut off a part of the light bundle at the location of the shade plate "6". The edge "7" is formed to have the configuration similar to the second focal line "4" in the plan view or as viewed in the direction of z-axis, and the edge "7" is arranged near to the second focal line "4" of the reflective surface "3".

Shown at numeral "8" is a projector lens disposed in front of the shade plate "6", and the optical axis $x_1$—$x_1$ of the projector lens "8" is parallel to the optical axis X—X of the headlight "1". The focus $F_c$ of the projector lens "8" is at the location corresponding to the edge "7" of the shade plate "6".

Shown at numeral "9" is a light source such as a filament of an electric bulb and is located on the focus F of the reflector "2".

FUNCTION (FIG. 2)

Figure 2:
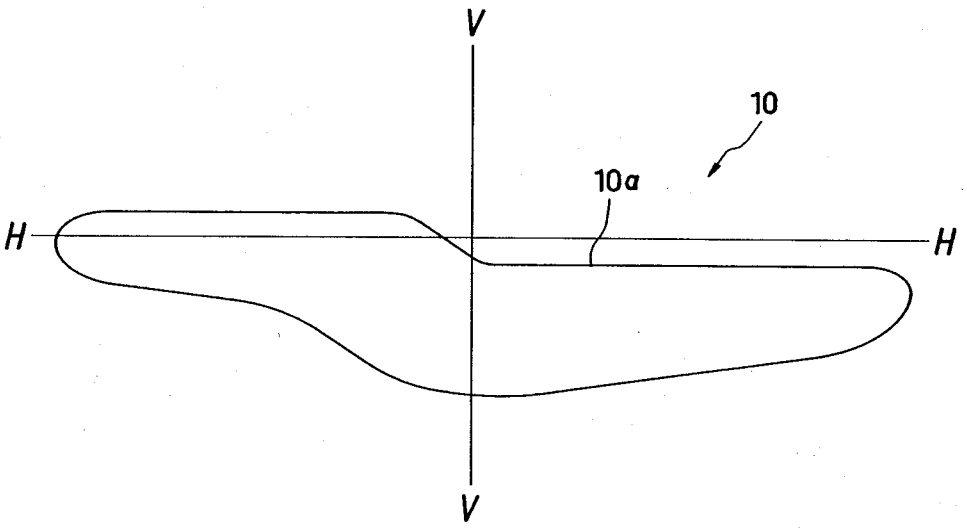
Figure 8A:
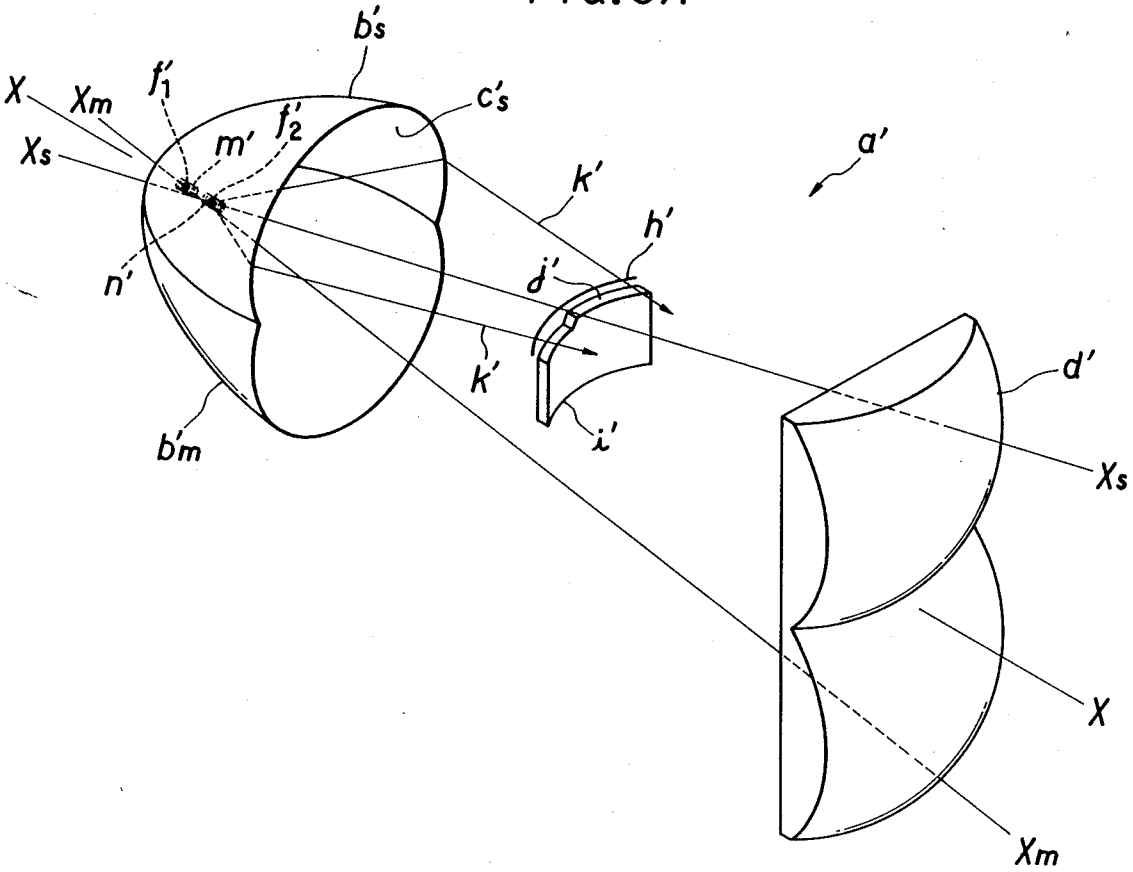
FIG. 8(A) is a schematic perspective view showing the arrangement of reflective elements of the headlight.
Figure 8B:
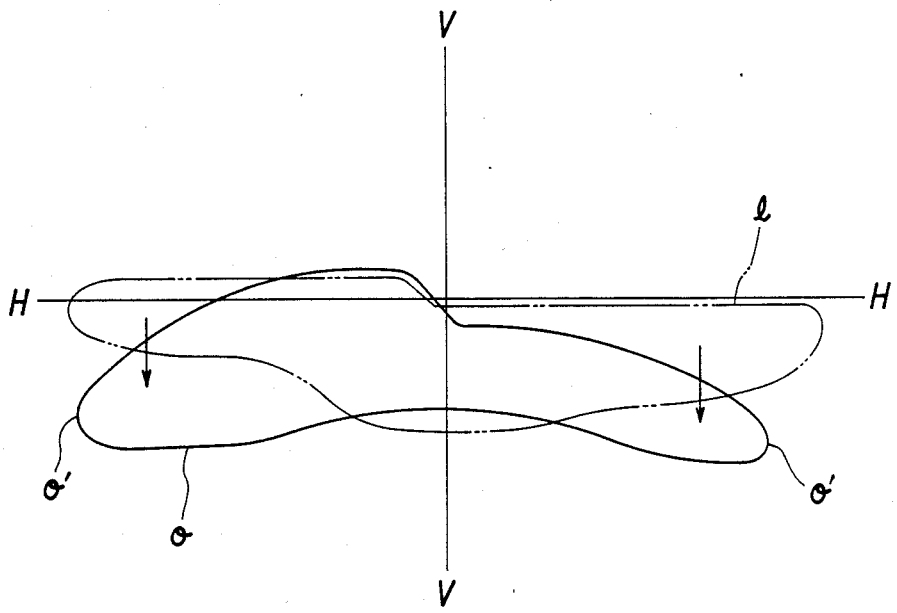
FIG. 8(B) is a view showing the pattern of the light beam of the prior art and of the present invention.
Figure 9A:
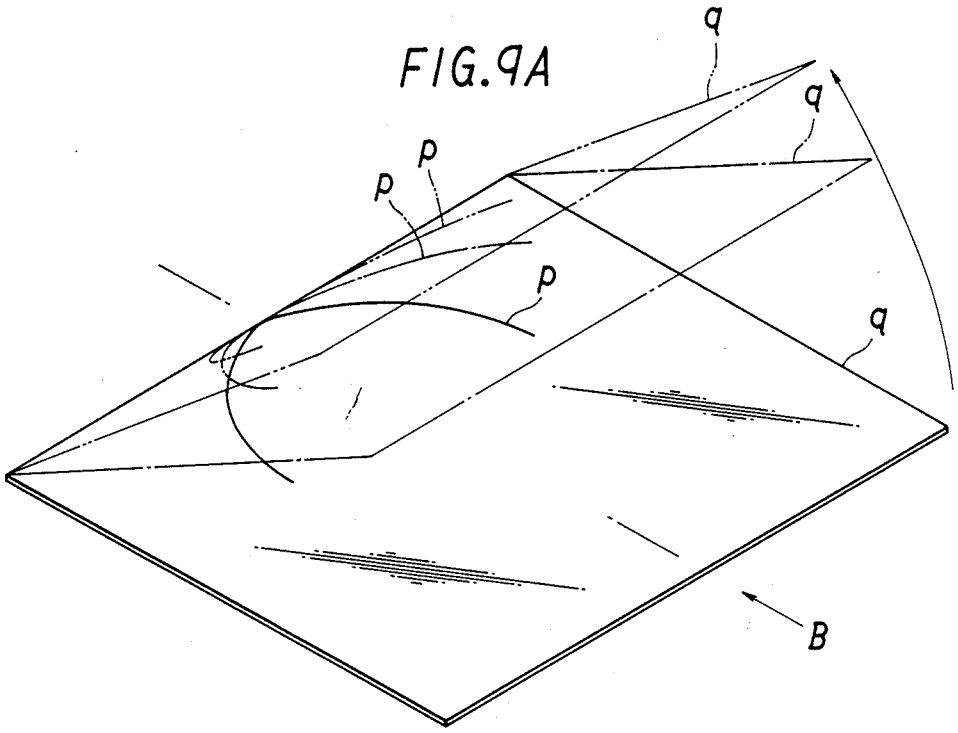
FIG. 9(A) through FIG. 9(C) are views for illustrating the drooping phenomenon in the pattern.
Figure 9B:
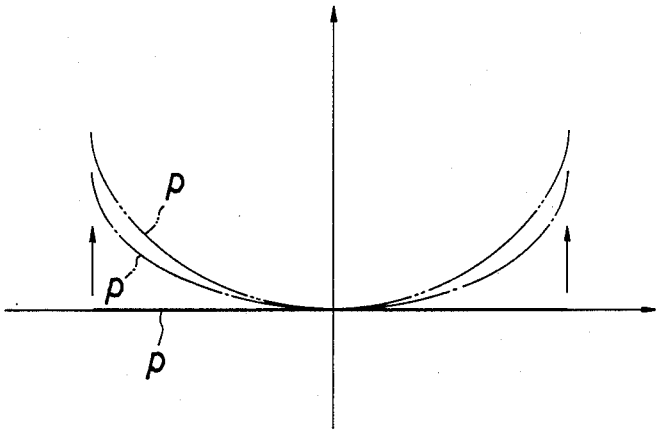
Figure 9C:
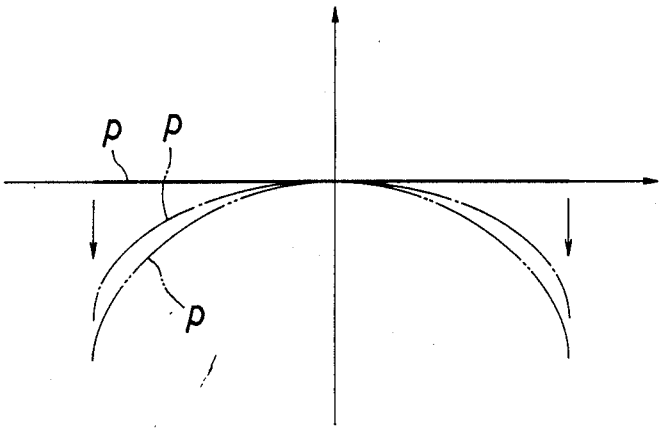

In the headlight "1", the light emitted from the light source "9" and reflected on the reflective surface "3" will converge on the second focal line "4". As viewed from the direction parallel to the optical axis X—X, the second focal line "4" is a straight line and, does not have the drooping phenomenon of the light beam pattern which is shown in FIG. 8(B), thus, as shown in FIG. 2, the upper edge 10*a* of the pattern "10" extends horizontally and distinctly.

THE REFLECTIVE SURFACE (FIG. 3~FIG. 6)

Now, description will be made with respect to the procedure for attaining equations representing the reflective surface "3" of the headlight "1" according to the present invention.

The second focal line "4" of the reflective surface "3" is a quadratic curve (elliptic curve in the embodiment) in the plan view, and the light emitted from the point source of light disposed on the first focus F and reflected on the reflective surface "3" converges on the second focal line "4" and, thereafter, converges on the third focal line "5".

SETTING THE CO-ORDINATE (FIG. 3)

As shown in the drawing, by setting x-axis on the optical axis $x_r$—$x_r$ of the reflective surface "3", y-axis to intersect vertically with the x-axis at the origin O(0, 0, 0) and z-axis to extend horizontally, then, the first focus F, the second focus K and the third focus D are respectively defined as F(f, 0, 0), K(k·f, 0, 0) and D(d·f, 0, 0) respectively.

A plane $\pi$ is a plane intersecting with x-y plane at angle $\theta$, and defines a straight line passing through the point K and being parallel to y-axis. The sign of the angle $\theta$ is plus in the counterclockwise direction as viewed from the minus side to the plus side of y-axis, thus, the angle $\theta$ shown in FIG. 3 has the minus sign.

The co-ordinate of the plane $\pi$ are y'-axis parallel to y-axis, x'-axis intersecting with x-axis at the point K and perpendicular to y'-axis, and z'-axis perpendicular to x'- and y'-axis. These axises intersect with each other at point R($x_r$, $y_r$, $z_r$).

An ellipse 11 corresponding the second focal line "4" of the reflective surface "3" is located on the plane $\pi$, and the ellipse 11 passes the point K, has the center R, and has the major radius "a" in the direction of x'-axis and the minor radius "b" in the direction of y'-axis. The parameter "a" can be determined from parameters k, d, f, $\theta$ and the like as described hereinafter.

The center R of the ellipse 11 is on a perpendicular line to the plane $\pi$ and passing the point D(d·f, 0, 0).

Shown at numeral 12 is a straight line on the plane $\pi$ passing the point R and intersecting with x'-axis at an angle $\omega$. A point Q($x_q$, $y_q$, $z_q$) is defined as the point of intersection between the line 12 and the ellipse 11 and near to the first focus F.

Any desired point on the reflective surface is shown at P(x, y, z).

INTRODUCTION OF EQUATIONS (FIG. 4~FIG. 6)

The reflective surface is the aggregation of point P which satisfies the following equation:

$$\overline{FP}+\overline{PQ}+\overline{QD}=\overline{OF}+\overline{OD} \quad (1)$$

The equation (1) represents the reflective surface.

However, the equation of the reflective surface is determined such that a spacial figure defined by the equation $\overline{FP}+\overline{PQ}=\overline{OF}+\overline{OD}-\overline{QD}$ or to represent the aggregation of the point of intersection between the elliptic member and the plane QRD.

PARAMETERS RELATING THE ELLIPSE (FIG. 4)

The co-ordinate of the point R($x_r$, $y_r$, $z_r$) is obtained from input parameters.

Figure 3:
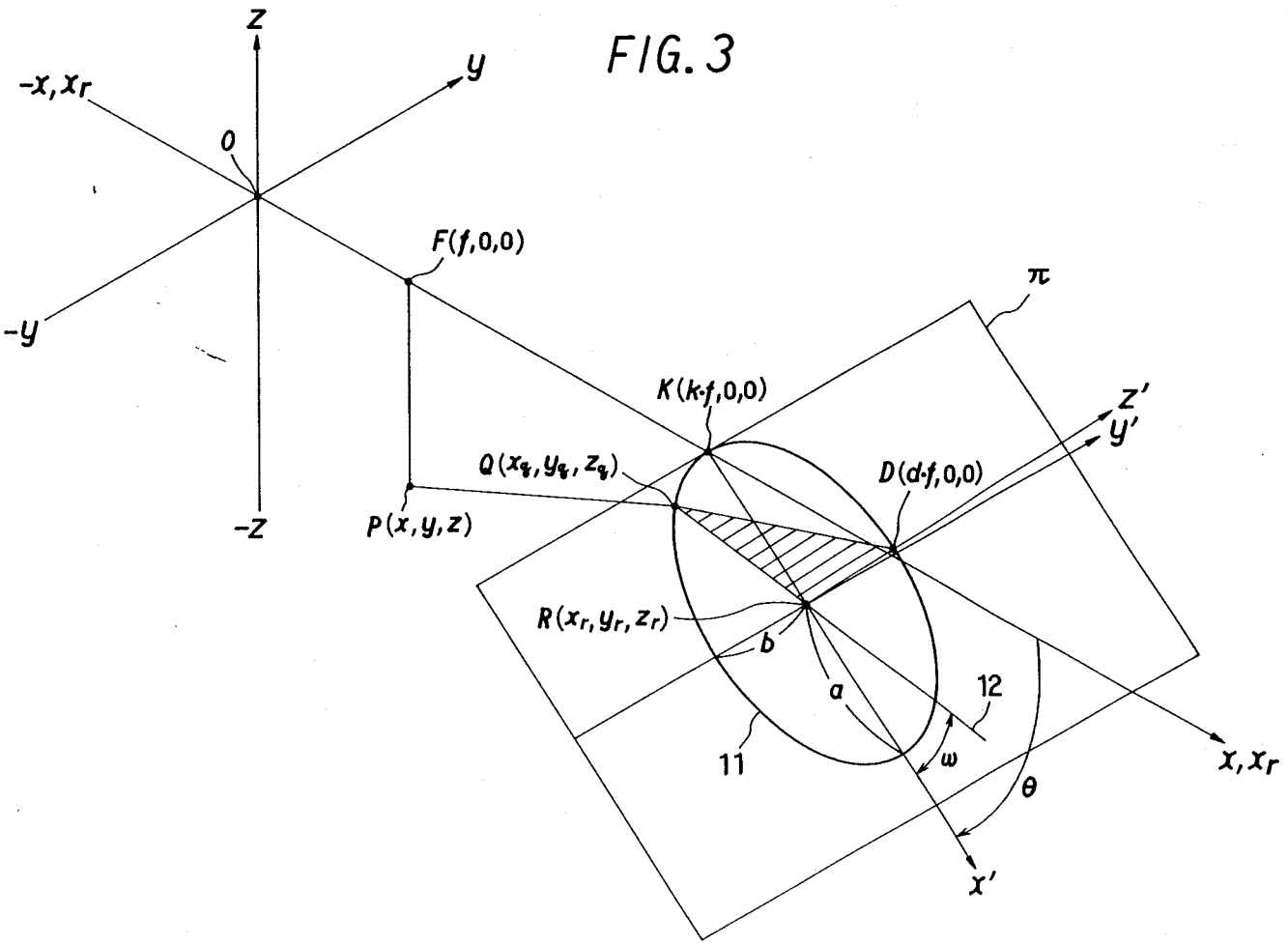

From the geometric relationship shown in FIG. 3, the major radius "a" of the ellipse 11 is:

$$a = \overline{KR} = \overline{KD} \cdot \cos\theta = (d - k) \cdot f \cdot \cos\theta \quad (2)$$

$$\text{Thus, } x_r = \overline{OK} + \overline{KR} \cdot \cos\theta = k \cdot f + a \cdot \cos\theta$$

$$y_r = 0$$

$$z_r = \overline{KR} \cdot \sin\theta = a \cdot \sin\theta$$

$$\therefore R(x_r, y_r, z_r) = (k \cdot f + a \cdot \cos\theta, 0, a \cdot \sin\theta) \quad (3)$$

Next, from the equation of the line 12 on the plane $\pi$ the value of tan ($\omega$) is determined in x-y-z co-ordinate.

Figure 4A:
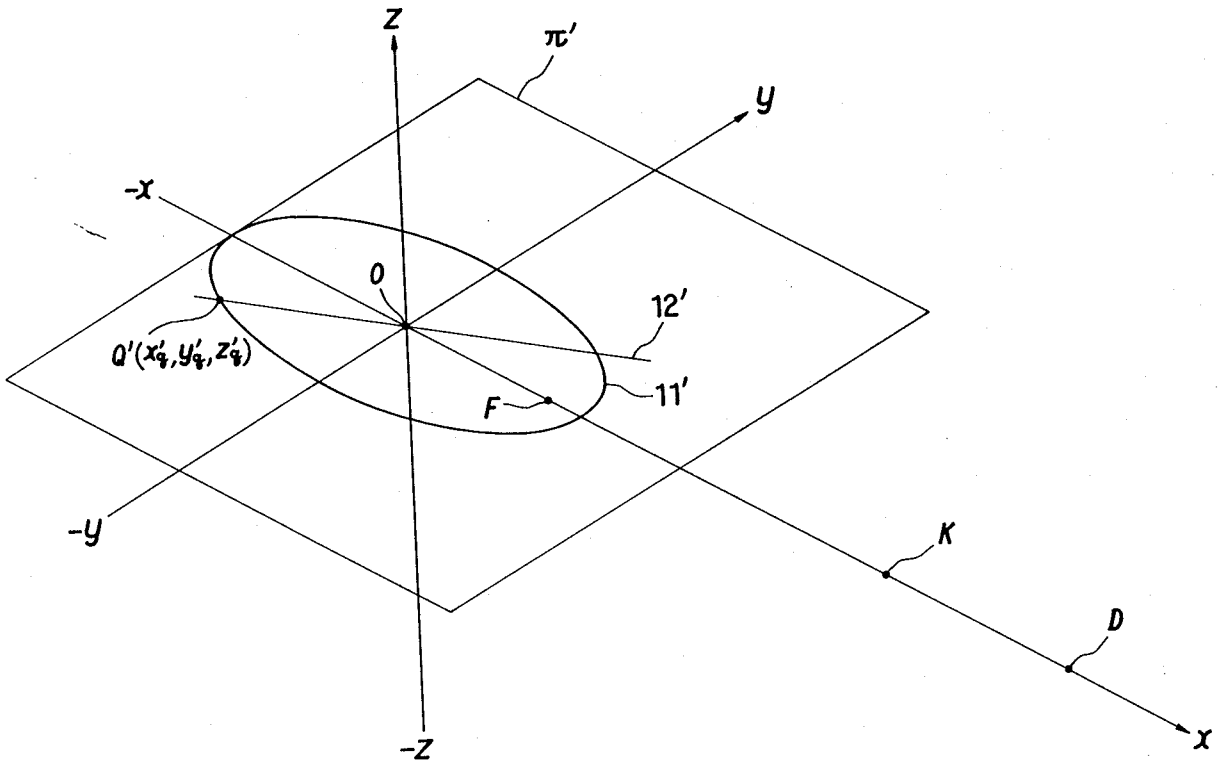
FIG. 4(A) is a view showing the co-ordinate of the initial figure.
Figure 4B:
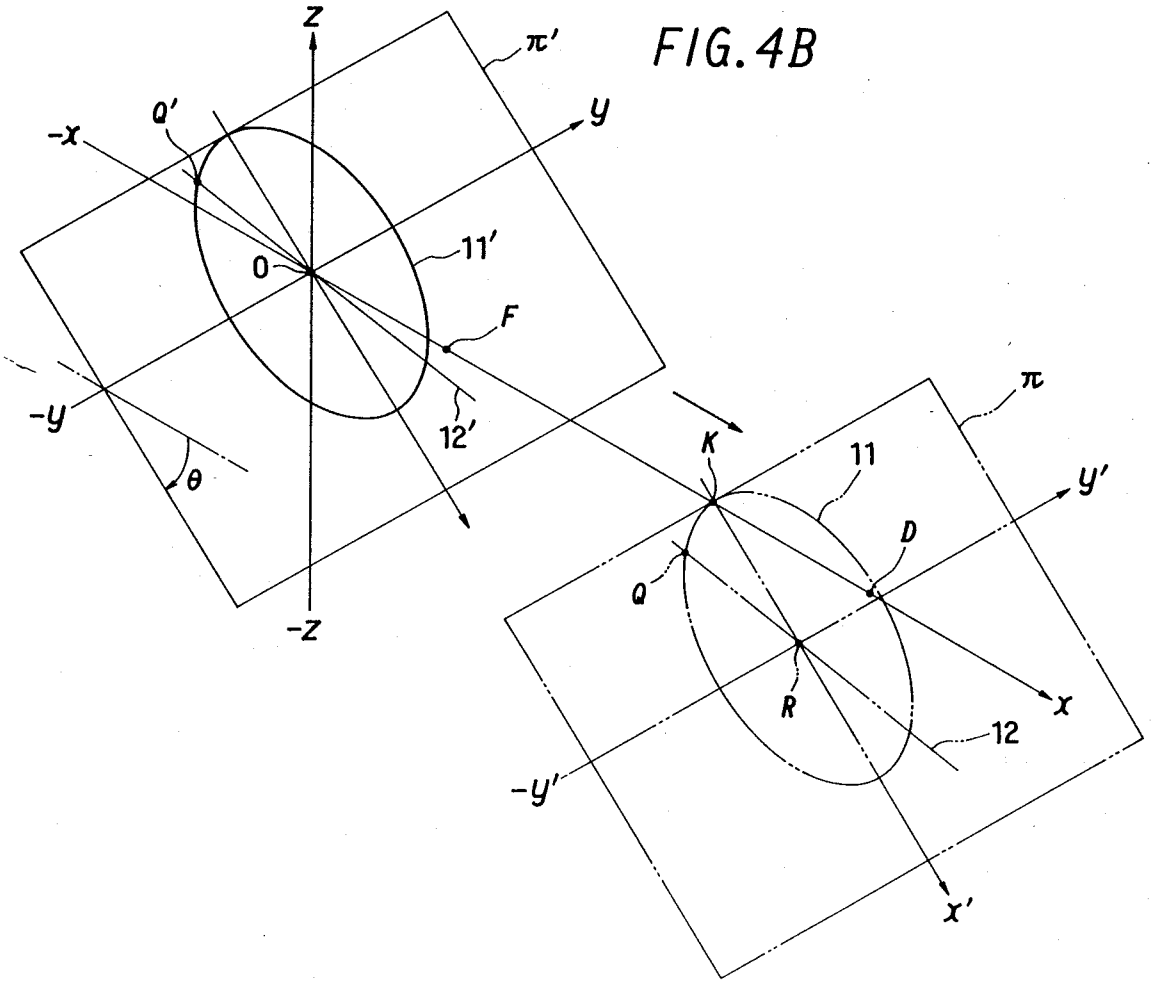
FIG. 4(B) is a view showing the translation and rotation procedure.

Following translation procedure is applied:

As shown in FIG. 4(A), a figure on the plane $\pi'$ on x-y plane the ellipse 11' and the straight line 12' are rotated around y-axis and in clockwise direction by the angle $\theta$ as shown in FIG. 4(B) and, thereafter, translate it so that the center O of the ellipse 11' is on the point R, then, the ellipse 11' and the straight line 12' on the plane $\pi'$ are coincided with the ellipse 11 and the straight line 12 on the plane $\pi$.

Mathematically, in x-y-z system, by determining the initial co-ordinate is (x, y, z) and the co-ordinate after the displacement is ($x^t$, $y^t$, $z^t$), then the matrix of the rotation around y-axis is:

$$T = \begin{pmatrix} \cos\theta & 0 & -\sin\theta \\ 0 & 1 & 0 \\ \sin\theta & 0 & \cos\theta \end{pmatrix}$$

From rotation T and translation vector ($x_r$, $y_r$, $z_r$), $$\begin{pmatrix} x^t \\ y^t \\ z^t \end{pmatrix} = \begin{pmatrix} \cos\theta & 0 & -\sin\theta \\ 0 & 1 & \theta \\ \sin\theta & 0 & \cos\theta \end{pmatrix} \begin{pmatrix} x \\ y \\ z \end{pmatrix} + \begin{pmatrix} x_r \\ y_r \\ z_r \end{pmatrix} \quad (4)$$

Thus, $$\begin{pmatrix} x \\ y \\ z \end{pmatrix} = \begin{pmatrix} \cos\theta & 0 & \sin\theta \\ 0 & 1 & 0 \\ -\sin\theta & 0 & \cos\theta \end{pmatrix} \begin{pmatrix} x^t - x_r \\ y^t - y_r \\ z^t - z_r \end{pmatrix} \quad (4')$$

The equation of the line on the plane $\pi'$ is:

$$y = \tan\omega \cdot x \quad (5)$$

When the equation (5) is displaced, by introducing x- and y-values obtained from the equation (4') [$x = \cos\theta \cdot (x^t - x_r) + \sin\theta \cdot (z^t - z_r)$ and $y = y^t - y_r$] into equation (5), then, $$y^t - y_r = \tan\omega \cdot [\cos\theta \cdot (x^t - x_r) + \sin\theta \cdot (z^t - z_r)]$$

Since $y_r = 0$. Thus, from the equation (3), $$y^t = \tan\omega \cdot [\cos\theta \cdot (x^t - x_r) + \sin\theta \cdot (z^t - z_r)]$$

By changing ($x^t$, $y^t$, $z^t$) into (x, y, z) and modifying the equation:

$$\tan\omega = y / [\cos\theta \cdot (x - x_r) + \sin\theta \cdot (z - z_r)] \quad (6)$$

Next, the co-ordinate of the point Q on the ellipse 11 will be got:

Similar to the preceding procedure, the point of intersection Q'($x'_q$, $y'_q$, $z'_q$) between the ellipse 11' and the line 12' on the plane $\pi'$ is determined and, the point Q' is displaced to the point Q.

As shown in FIG. 4(A), the ellipse on the plane $\pi'$ is represented by following equation under the co-ordinate system (x', y', z') fixed to the plane $\pi'$:

$$x'^2/a^2 + y'^2/b^2 = 1 \quad (7)$$

Thus, among two intersecting points between the line 12' which is defined by the equation ($y' = \tan\omega \cdot x'$) and the equation (7), one which is near to the point F or satisfying the equation ($x'_q < 0$) is the point Q'(x', y')

$$x' = \pm(a \cdot b)/[b^2 + a^2 \cdot \tan^2\omega]^{\frac{1}{2}}$$

Since (a>0 and b>0)

$$x'_q = -(a \cdot b)/[b^2 + a^2 \cdot \tan^2\omega]^{\frac{1}{2}}$$

$$y'_q = -(a \cdot b \cdot \tan\omega)/[b^2 + a^2 \cdot \tan^2\omega)^{\frac{1}{2}}$$

The ellipse 11' is on x'-y' plane, thus, ($z'_q = 0$), and co-ordinate of the point Q'($x'_q$, $y'_q$, $z'_q$) is:

$$Q' = [-(a \cdot b)/[b^2 + a^2 \cdot \tan^2\omega]^{\frac{1}{2}}, -(a \cdot b \cdot \tan\omega)/[b^2 + a^2 \cdot \tan^2\omega]^{\frac{1}{2}}, 0] \quad (8)$$

In applying the displacement procedure on Q'($x'_q$, $y'_q$, $z'_q$), equations (4) and (8) are utilized:

$$x_q^t = x'_q \cdot \cos\theta + 0 \cdot \sin\theta + x_r = -a \cdot b \cdot \cos\theta / [b^2 + a^2 \cdot \tan^2\omega]^{\frac{1}{2}} + x_r$$

$$y_q^t = y'_q = -a \cdot b \cdot \tan\omega / [b^2 + a^2 \cdot \tan^2\omega]^{\frac{1}{2}}$$

$$z_q^t = x'_q \cdot \sin\theta + 0 \cdot \cos\theta + x_r = -a \cdot b \cdot \sin\theta / [b^2 + a^2 \cdot \tan^2\omega]^{\frac{1}{2}} + z_r$$

By substituting ($x^t_q$, $y^t_q$, $z^t_q$) by ($x_q$, $y_q$, $z_q$), the co-ordinate of Q is obtained as follows:

$$Q(x_q, y_q, z_q) = [-a \cdot b \cdot \cos\theta / [b^2 + a^2 \cdot \tan^2\omega]^{\frac{1}{2}} + x_r, -a \cdot b \cdot \tan\omega / [b^2 + a^2 \cdot \tan^2\omega]^{\frac{1}{2}}, -a \cdot b \cdot \sin\theta / [b^2 + a^2 \cdot \tan^2\omega]^{\frac{1}{2}} + z_r] \quad (9)$$

EQUATION OF REFLECTING SURFACE

By applying equations (2) through (9) to equation (1), the reflective surface $f_r(x, y, z)$ can be obtained from the point (x, y, z) satisfying the following equation:

$$
\begin{aligned}
f_t(x, y, z) &= \overline{FP} + \overline{PQ} + \overline{QD} - \overline{OF} - \overline{OD}, \text{ then,} \\
&= [(x - f)^2 + y^2 + z^2]^{1/2} + \\
&\quad [(x - x_q)^2 + (y - y_q)^2 + (z - z_q)^2]^{1/2} + \\
&\quad [(x_q - d \cdot f)^2 + y_q^2 + z_q^2]^{1/2} - \\
&\quad (d + 1) \cdot f \\
&= 0
\end{aligned}
\tag{10}
$$

wherein: $(x_q, y_q, z_q)$, $(x_r, y_r, z_r)$, tan $\omega$ and "a" are obtained respectively from equations (9), (3), (6) and (2) respectively.

EXAMPLE OF CONFIGURATION OF REFLECTIVE SURFACE

FIG. 5 show the configuration of a reflective surface which is obtained by setting F=15.0 mm, k=3.0, d=5.0, $\theta$=20° and b=30.0 mm, and by utilizing a computer.

In FIG. 5 the direction of y-axis and z-axis is opposite to that of FIG. 3.

Figure 5A:
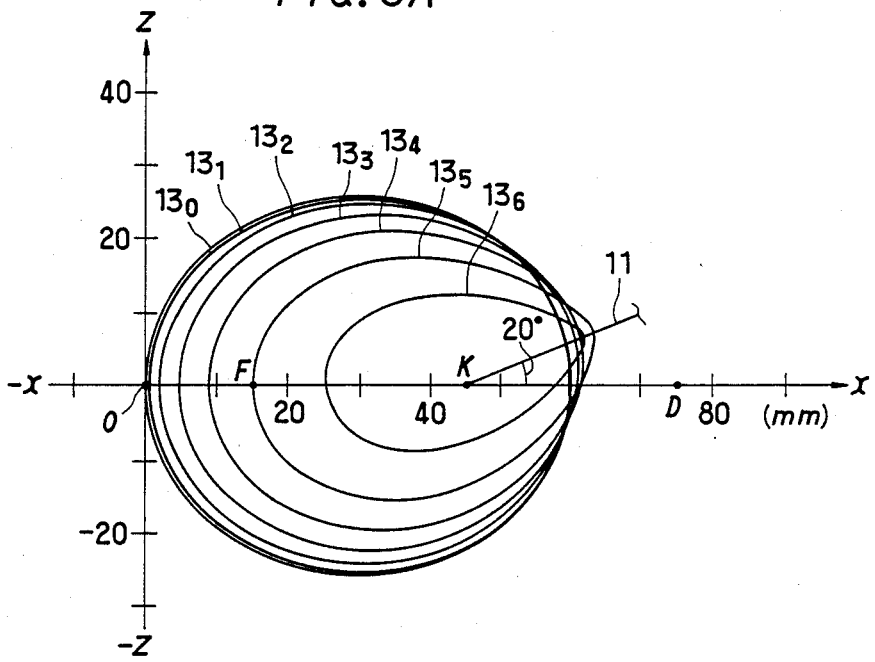
FIG. 5(A) through FIG. 5(C) are views showing the coordinate of the reflective surfaces according to the present invention.
Figure 5B:
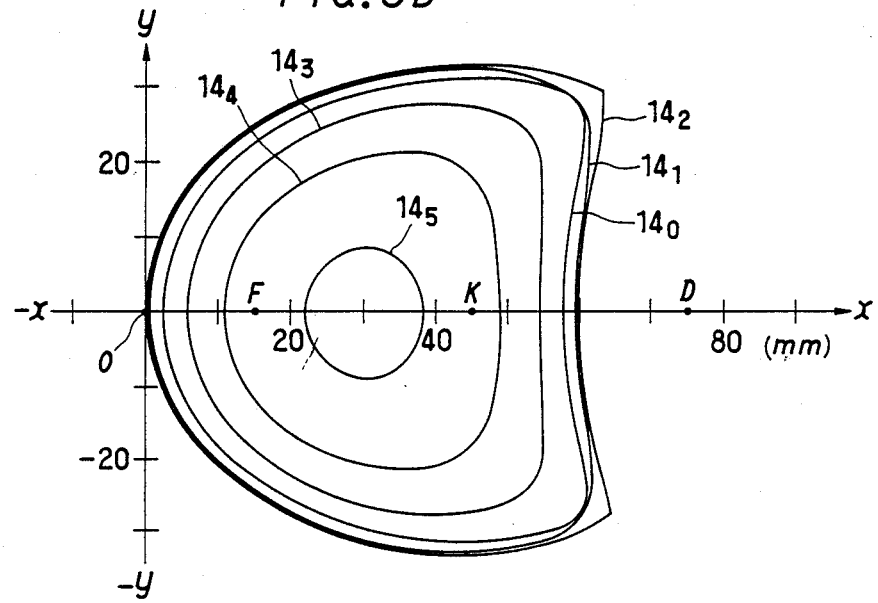
Figure 5C:
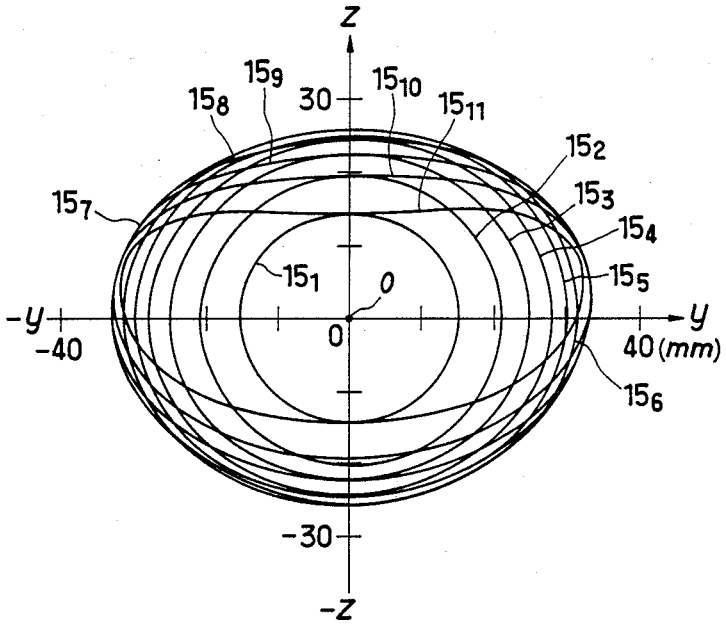

FIG. 5(A) shows a vertical section parallel to the optical axis, FIG. 5(B) shows a horizontal section and FIG. 5(C) shows a section perpendicular to the optical axis.

Shown at $\mathbf{13}_0 \sim \mathbf{13}_6$ respectively in FIG. 5(A) are sections at y=0, 5, 10, . . . 30 mm, at $\mathbf{14}_0 \sim \mathbf{14}_5$ in FIG. 5(B) are respectively sections at z=0, 5, . . . 25 mm and at $\mathbf{15}_1 \sim \mathbf{15}_{11}$ respectively in FIG. 5(C) are sections at x=5, 10, 15, 20, . . . 55 mm.

FIG. 6 show the configuration of the reflective surface obtained by displacing the surface of FIG. 5 to the position corresponding to the reflective surface of FIG. 3. Namely, the reflective surface of FIG. 5 is rotated around an axis passing the point F and being perpendicular to x-z plane by the angle $\theta$ so that the plane $\pi$ including the ellipse is parallel to x-y plane and, thereafter, mirror image conversion is effected symmetrically with x-y plane.

Assuming the initial point is (x, y, z) and the point after the displacement is $(x^t, y^t, z^t)$, then $$
\begin{pmatrix} x \\ y \\ z \end{pmatrix} = \begin{pmatrix} 1 & 0 & 0 \\ 0 & 1 & 0 \\ 0 & 0 & -1 \end{pmatrix} \left[ \begin{pmatrix} \cos\theta & 0 & \sin\theta \\ 0 & 1 & 0 \\ -\sin\theta & 0 & \cos\theta \end{pmatrix} \begin{pmatrix} x^t - f \\ y^t \\ z^t \end{pmatrix} + \begin{pmatrix} f \\ 0 \\ 0 \end{pmatrix} \right] \tag{11}
$$

$$x = \cos\theta \cdot (x^t - f) + \sin\theta \cdot z^t + f$$

$$y = y^t$$

$$z = \sin\theta \cdot (x^t - f) - \cos\theta \cdot z^t$$

Figure 6A:
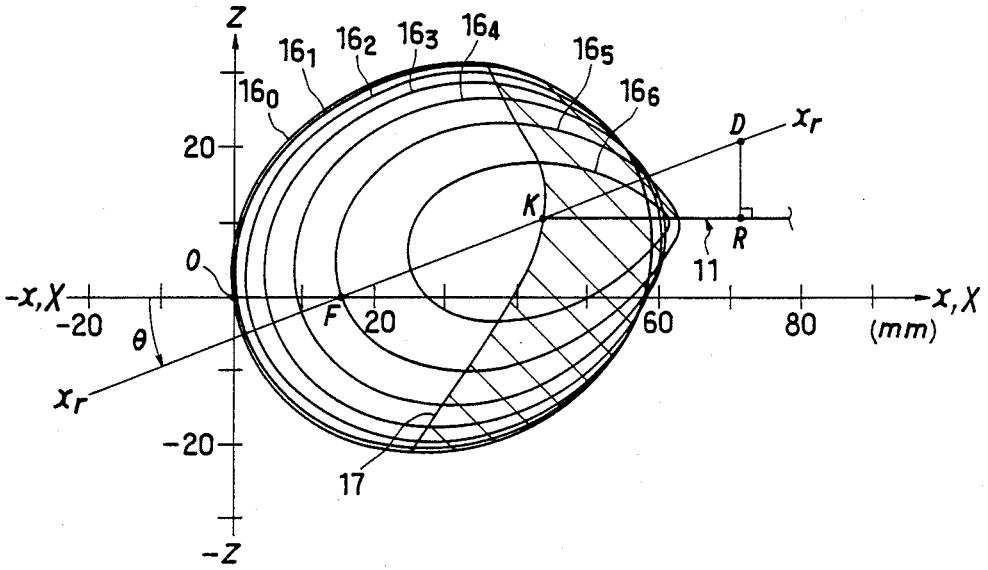
FIG. 6(A) through FIG. 6(C) are views corresponding to FIG. 5(A) through FIG. 5(C) respectively and showing the condition when the reflective surfaces are displaced to the position of the reflective surface shown in FIG. 1.
Figure 6B:
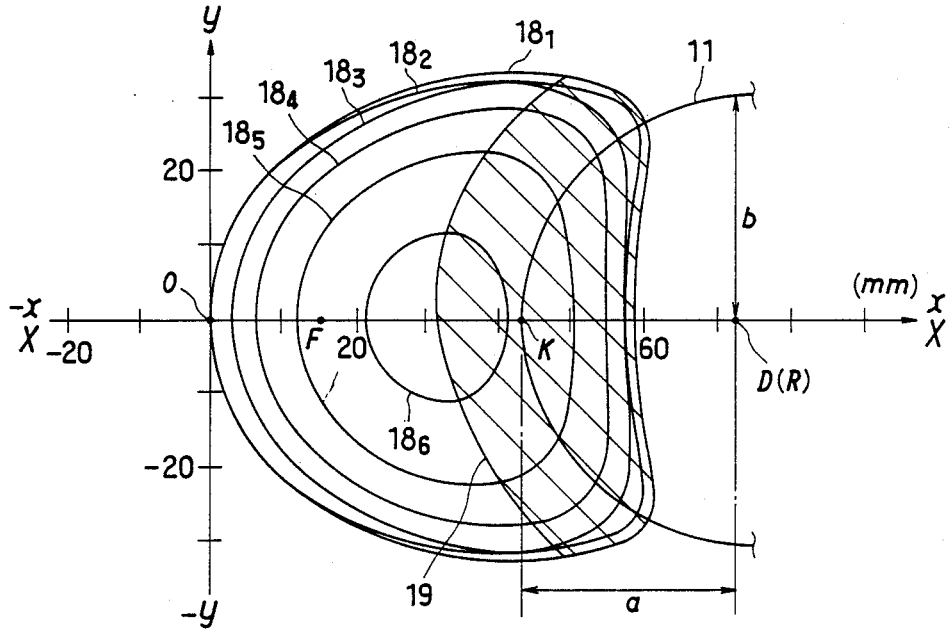
Figure 6C:
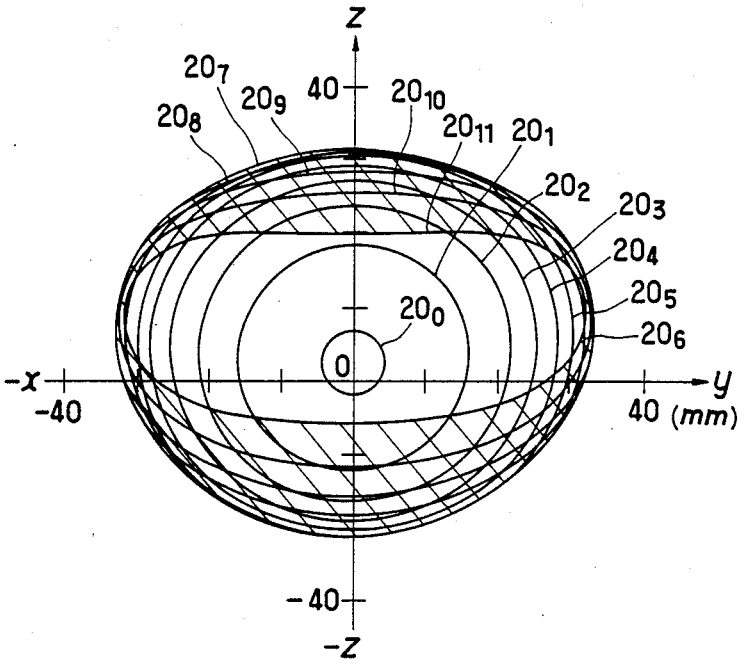
Figure 7:
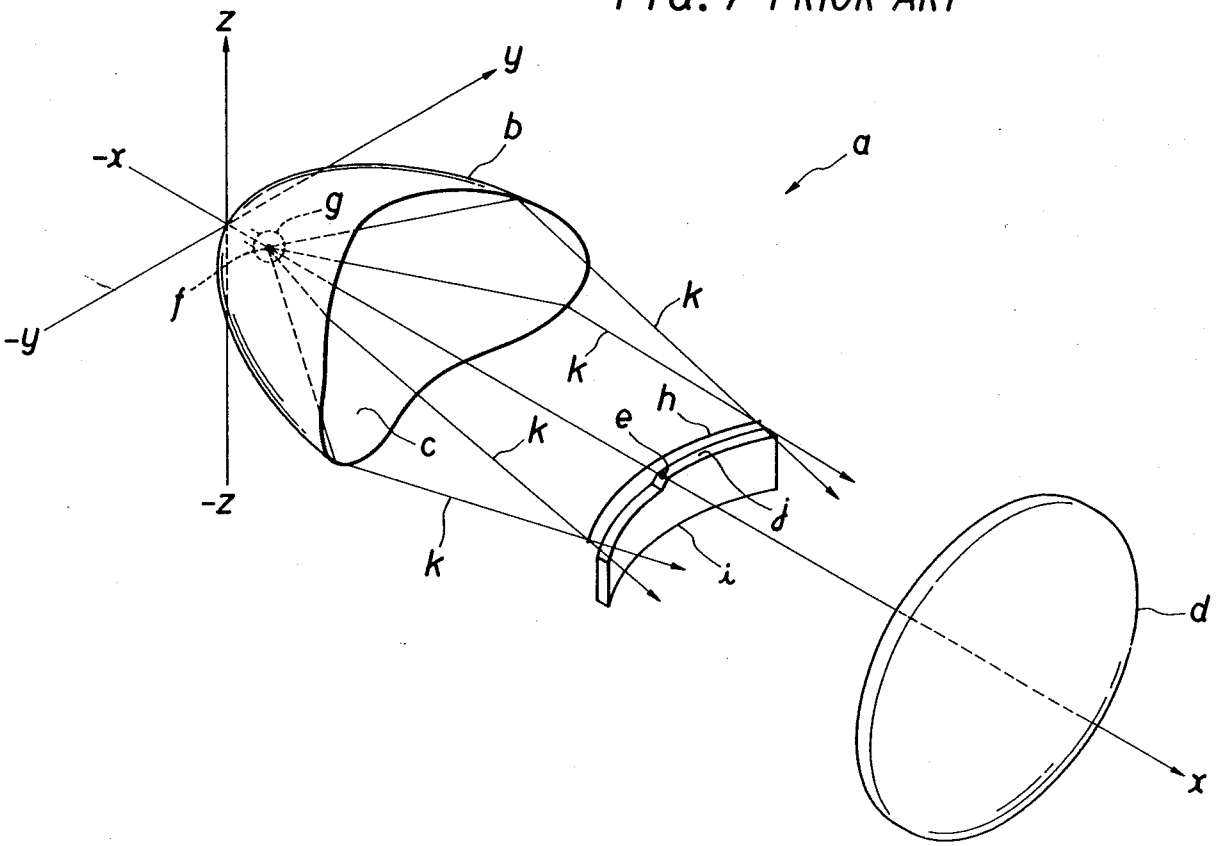
FIG. 7 PRIOR ART
FIG. 7 is a schematic perspective view of a prior art headlight device.

FIG. 6(A) is a vertical section parallel to the optical axis X—X of the headlight "1", FIG. 6(B) is a horizontal section and FIG. 6(C) is a sectional view vertical to the optical axis X—X of the headlight "1".

Shown at numerals $\mathbf{16}_0 \sim \mathbf{16}_6$ in FIG. 6(A) are sections respectively at y=0, 5, 10, . . . 30 mm, and at 17 is the front edge of the reflective surface. The normal line to the reflective surface at the point on the edge line 17 is perpendicular to the x-axis. The shaded portion in the drawing is located in front of the edge line 17 and, in mold forming the reflective surface, the shaded portion shows the draft angle of the minus value, thus, is not used as the reflective surface.

Shown at numerals $\mathbf{18}_1 \sim \mathbf{18}_5$ in FIG. 6(B) are sections respectively at z=5, 10, . . . 30 mm, and the shaded portion defined by line 19 is not utilized as the reflective surface.

Shown at numerals $\mathbf{20}_0 \sim \mathbf{20}_{11}$ in FIG. 6(C) are sections respectively at x=0, 5, 10, . . . 55 mm.

When a point light source is located on the first focus F of the reflective surface of the configuration as shown in FIG. 6(A)~FIG. 6(C), the light reflected on the surface converges on the second focus of elliptic form and, thereafter, converges on the third focus.

Advantages of the Invention

As described heretofore in detail, according to the invention, in a headlight having a reflector with the optical axis thereof being inclined relative to the optical axis of the headlight, a light source provided on a focus of the reflector and on the optical axis thereof, a projector lens in front of the reflector, and a shade plate provided nearly on a focus of the projector lens, the reflective surface of the reflector is formed to reflect the light emitted from the light source and to converge the reflected light into a curved line on a plane parallel to a plane including the optical axis of the headlight. Thus, the light reflected on the reflective surface of the reflector converges on a curved line on a plane parallel to the optical axis of the headlight, so that the converged light does not have any drooping phenomenon as viewed in the direction parallel to the optical axis of the headlight.

In the embodiment, the second focal line is an elliptic curve, but the invention may be applied to any desired quadratic curves.

What is claimed:

1. A headlight having a reflector with the optical axis thereof being inclined relative to the optical axis of the headlight, a light source provided on a focus of the reflector and on the optical axis thereof, a projector lens in front of the reflector, and a shade plate provided nearly on a focus of the projector lens, wherein the reflector comprises a reflective surface which reflects the light emitted from the light source and converges the reflected light into a curved line on a plane parallel to a plane including the optical axis of the headlight.

2. A headlight as claimed in claim 1, wherein the curved line is an elliptic curve.

3. A headlight as claimed in claim 1, wherein the reflected light converges on the curved line (referred as a second focal line) and, thereafter, converges on a third focal line.

4. A headlight as claimed in claim 3, wherein the curved line is a part of an ellipse.

5. A headlight as claimed in claim 1, wherein the reflected light forms the low beam.

* * * * *